US005810243A

United States Patent [19]

DiPinto et al.

[11] Patent Number: 5,810,243

[45] Date of Patent: Sep. 22, 1998

[54] PAPERBOARD CARTONS HAVING PROTECTED BOARD RAW EDGES SURFACES AND METHOD OF MANUFACTURE

[75] Inventors: John M. DiPinto; Gerald A. Marano, both of Mobile, Ala.; Edward Bombolevich, Ringwood, N.J.; Charles E. Gibbons, Mobile, Ala.

[73] Assignee: International Paper Company, Tuxedo Park, N.Y.

[21] Appl. No.: 842,539

[22] Filed: Apr. 15, 1997

Related U.S. Application Data

[62] Division of Ser. No. 415,871, Apr. 3, 1995, abandoned.

[51] Int. Cl.[6] ..... B65D 5/40; B65D 5/42

[52] U.S. Cl. ..... 229/198.2; 229/3.1; 428/34.2

[58] Field of Search ..... 229/3.1, 125.42, 229/198.2; 428/34.2, 60

[56] References Cited

U.S. PATENT DOCUMENTS

| | | | |
|---|---|---|---|
| 2,190,479 | 2/1940 | Moore . | |
| 3,067,923 | 12/1962 | Thiets . | |
| 3,197,112 | 7/1965 | Meyer-Jagenberg . | |
| 3,411,694 | 11/1968 | Silver . | |
| 3,495,507 | 2/1970 | Haas et al. . | |
| 3,604,317 | 9/1971 | Baun . | |
| 3,654,842 | 4/1972 | Schwenk . | |
| 3,846,220 | 11/1974 | Buchner | 229/198.2 |
| 3,942,708 | 3/1976 | Christensson . | |
| 4,192,446 | 3/1980 | Naito . | |
| 4,239,150 | 12/1980 | Schadowski et al. | 229/198.2 |
| 4,540,391 | 9/1985 | Fries, Jr. . | |
| 4,572,426 | 2/1986 | Lisiecki . | |
| 4,617,211 | 10/1986 | Fries, Jr. . | |
| 4,701,360 | 10/1987 | Gibbons et al. | 229/3.1 |
| 4,708,708 | 11/1987 | Fries, Jr. . | |
| 4,802,620 | 2/1989 | Phillips . | |
| 5,021,040 | 6/1991 | Phillips . | |

FOREIGN PATENT DOCUMENTS

| | | | |
|---|---|---|---|
| 4036454 | 5/1992 | Germany | 229/198.2 |
| 4218393 | 12/1993 | Germany | 229/198.2 |

*Primary Examiner*—Gary E. Elkins
*Attorney, Agent, or Firm*—Hoffman, Wasson & Gitler

[57] ABSTRACT

A paperboard polymer coated carton having protected board raw edge surfaces for packaging food and non-food products is provided in which a thin slice of the inside carton raw edge surface is removed or skived away from the side seam flap. The thin slice includes all of the inside polymer layers and most of the paperboard. The resulting outside flap is folded into the carton inside over the paperboard raw edge surface, and is flame sealed to the inside polar polymer layer, to seal the paperboard raw edge surface. The sealed edge surface is then flame sealed to the inside of the opposite paperboard surface, thereby creating an additional inside-outside flame seal. By such a process only inside-outside seals are formed or polar-covalent seals.

7 Claims, 3 Drawing Sheets

PAPERBOARD CARTONS HAVING PROTECTED BOARD RAW EDGES SURFACES AND METHOD OF MANUFACTURE

This application is a division of Ser. No. 08/415,871 filed Apr. 3, 1995, now abandoned.

BACKGROUND OF THE INVENTION

1. Field of the Invention

The present invention relates to paperboard polymer coated cartons having protected board raw edge surfaces and a method of manufacturing such cartons. More particularly, the present invention relates to a carton, such as International Paper Co.'s Dual-Lock carton, U.S. Pat. No. 4,540,391, in which there is no exposed raw edge along a fifth panel to reduce the occurrence of unsightly stains, and to prevent slow leaking or excessive oxidation of the product contained therein, and a corresponding method of manufacturing such a carton. Since all the seals are polar-non polar, a reverse skive and hem flame sealing technique is employed.

2. Description of the Prior Art

Paperboard containers are widely used for the packaging of foodstuffs such as powdered mixes, cereals, corn chips, and the like and are suitable for packaging liquids in general and many food substances, particularly those which are moisture-sensitive. Such containers are often formed from precut blanks comprising paperboard covered on both sides with a thermoplastic material such as polyethylene. Polyethylene inhibits the passage through the material of bacteria and other microorganisms, moisture, and the contents of the container. In addition, the thermoplastic coating serves as an adhesive when subjected to heat and pressure. As a result, seams or joints between overlapped edges of the blank may be made by applying heat and pressure to the overlapped edges.

During the manufacturing of these cartons, the blank is formed and seamed into a tube. In a standard or regular seam, one edge of the blank at the seam, is located inside of the container, hereinafter the inside seam, and is illustrated in FIG. 1. When the inside raw edge is exposed, the paperboard layer will come into contact with the contents of the container. Scoring on the raw edge become the avenue of penetration for liquid inside the container into the paperboard. Such contact is undesirable, since any liquid in the container wicking into the cut or raw edge of the blank, and thus the paperboard component of the laminate will corrupt the integrity of the container.

Numerous blank constructions have been developed to overcome these problems. These blank constructions commonly use low density polyethylene as the inside, (hereinafter the matte side) product contact, and outside, (hereinafter the gloss side) coating layers. Polyethylene, a covalent (non-polar) material is commonly used because it is inexpensive and has a broad heat seal window. Some aqueous and non-aqueous based products readily penetrate paperboard raw edge surfaces and are therefore hard to contain. The normal commercial practice, for containers of such products, is to modify the bottom configuration and to skive the side seam raw edge. Such skiving of the polyethylene, both inside and outside, of such cartons is achieved by removing a narrow layer of the gloss raw edge (side seam flap), bending that edge back on itself to the carton outside, and flame sealing the opposite carton edge to the modified carton edge to create an inside-outside (matte/gloss) and inside-inside (matte/matte) polyethylene seal. Such seams can be formed at rates up to 1500 feet per minute. FIG. 2 shows such a skived side seam.

Skiving of a carton side seal is a modification of the standard seal, which has side seam raw edge exposed to product. The standard side seam is used for easy to hold products, and is a flame sealed inside-to-outside polyethylene seal. All the seams have 100% fiber tear in the sealing area to insure the area is strong enough for product distribution.

International Paper Co. has developed an additional type of side seam, the subject of U.S. Pat. No. 4,540,391, termed skive and hem or skive-N-hem, which is shown in FIG. 3. According to the skive and hem process, a thin strip of the outside board raw edge (side seam flap) is cut away exposing the inside polyethylene polymer flap. *The inside flap is folded to the carton outside, back over the remaining board raw edge, and sealed to the outside polyethylene surface covering the board raw edge. The carton side seam is then formed by flame sealing the opposite inside carton edge to the skived and hemmed carton edge, thereby forming both inside-outside (matte/gloss) and inside-inside (matte/matte) seal surfaces.

All of the foregoing methods of side seaming form adequate commercial seals if covalent (non-polar) materials, such as polyethylene, are used for the inside and outside coating layers. Conventional sealing techniques are designed to remove or protect the product from paperboard raw edge exposure. However, these techniques fail if polar materials, such as, but not inclusive of, ethylene vinyl alcohol copolymer (EVOH), polyethylene terephthalate (PET), PETA, PETG, or nylon, or combinations thereof, are used for either the inside or outside seam seal because a commercially acceptable polar-polar (normally inside-inside) polymer seal using commercial flame sealing technology does not exist.

SUMMARY OF THE INVENTION

These and other deficiencies of the prior art are addressed by the present invention which is directed to a paperboard polymer coated carton having protected board raw edge surfaces for packaging food and non-food products.

Based on the foregoing, it is an object of the present invention to eliminate the side seam raw edge of cartons containing inside or outside product contact polar surfaces using a unique flame sealing technique called reverse skive-and-hem technique.

Another object of the present invention is to enhance the features of International Paper co.'s Dual-Lock carton or any carton containing polar product contact or outside polar polymer layers by eliminating the raw edge of paperboard on the fifth panel in a formed filled carton.

Yet another object of the present invention is to reduce the incidence of staining or leaking in cartons through the carton raw edge for hard-to-hold products.

Still another object of the invention is to reduce or eliminate any paper taste, imparted to flavor sensitive products, from the raw edge of the paperboard.

Another object of the present invention is to extend the normal shelf life of aggressive products contained in such cartons, by reducing oxidation.

Still another object of the present invention is to reduce the cost of the cartons by permitting the use of less expensive paperboard materials due to the reduction in wicking into the raw edges.

Yet another object of the present invention is to eliminate the bottom horizontal score splitting in the bottom side seam flap which can cause product leakage during distribution.

According to the method of the present invention, a thin slice of the inside (matte) carton raw edge surface is removed or skived away from the side seam flap. The thin slice includes all of the inside polymer layers and most of the paperboard. The resulting outside flap is folded into the carton inside over the paperboard raw edge surface, and is flame sealed, or sealed by some other source, e.g., infra-red lamp, to the inside (matte) polar polymer layer, to seal the paperboard raw edge surface. The sealed edge surface is then flame sealed to the inside (matte) of the opposite paperboard surface, thereby creating an additional inside-outside (matte/gloss) flame seal. By such a process only inside-outside (matte/gloss) seals are formed or polar-covalent (non-polar) seals, which are all commercially acceptable and achievable. The method of the present invention results in 100% fiber tearing seals and can be produced on commercial flame sealers at the standard high rates of sealing.

BRIEF DESCRIPTION OF THE DRAWINGS

These and other attributes of the present invention will be described with respect to the following drawings in which.

DETAILED DESCRIPTION OF THE INVENTION

Figure 1:
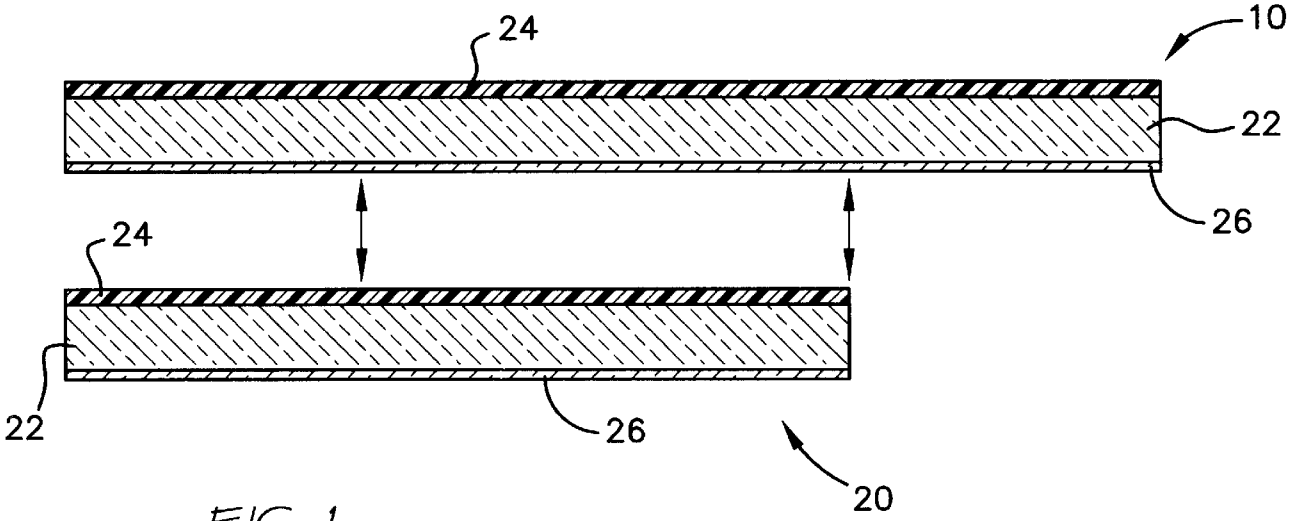
FIG. 1 is a cross sectional view of a regular or standard side seam.

Referring to the figures, a regular or standard side seam is shown in FIG. 1. The seam is formed by the portion of outer panel 10 that overlaps inner panel 20. Both the outer panel 10 and inner panel 20 have an inner core of paperboard 22, a non-polar outer coating 24, such as polyethylene, and a polar inner coating 26. When the standard seam is formed, the juncture between the inner panel 20 and the outer panel 10 is a polar/non-polar interface.

Figure 2:
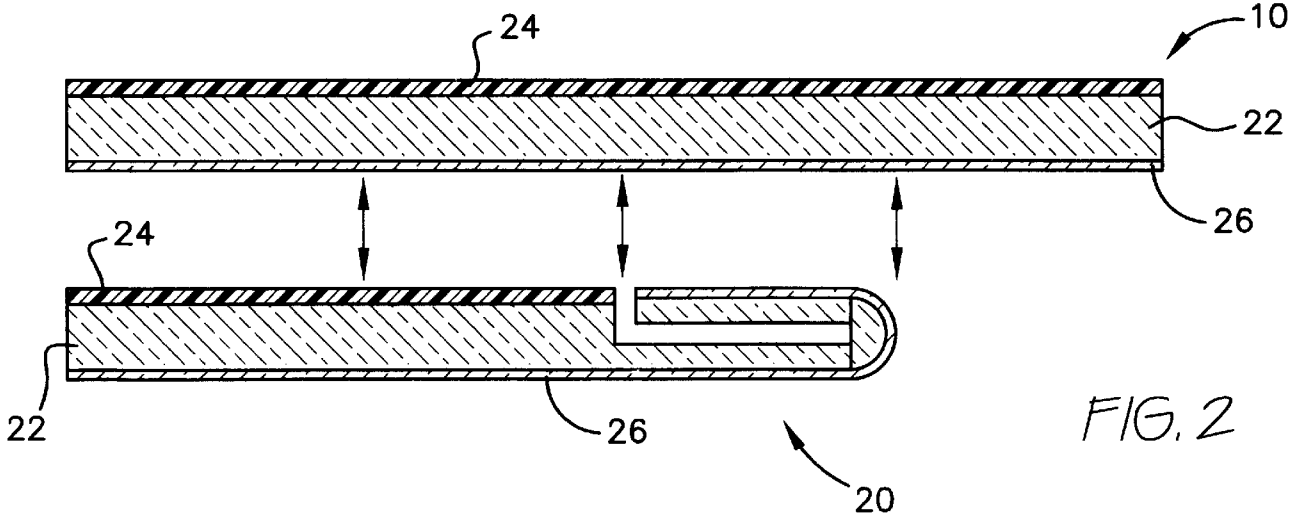
FIG. 2 is a cross sectional view of a skived side seam.

With a skived side seam, as shown in FIG. 2, the standard seam is modified by removing a narrow layer of the gloss raw edge, which includes the paperboard 22 and outer coating 24, from the inner panel 20, which is the side seam flap. The edge is then bent back on itself to the carton outside. The inner coating 26 on the outer panel 10 is then flame sealed to the modified carton edge to create matte/gloss and matte/matte seals, which are polar/non-polar and polar/polar, respectively.

Figure 3:
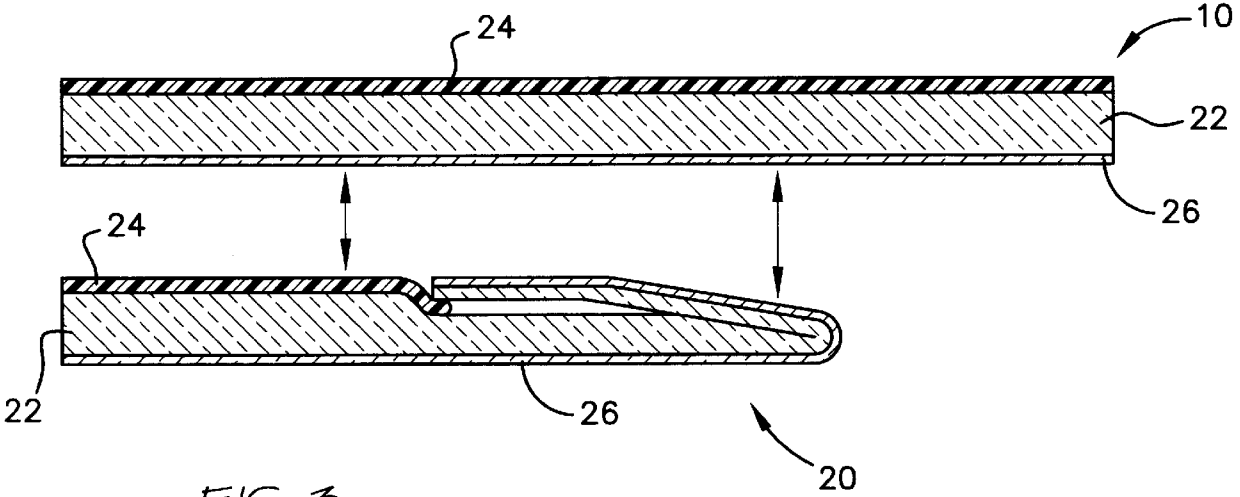
FIG. 3 is a cross sectional view of a skive and hem side seam.

In the skive and hem process shown in FIG. 3, a thin strip is cut away from the gloss side of inner panel 20, including the paperboard 22 and outer coating 24 along the raw edge. The inside flap, which consists of a small remaining portion of the paperboard 22, at most approximately 20% of the original paperboard 22, and mostly inner coating 26, is folded to the carton outside, back over the remaining paperboard 22 raw edge, and sealed to the outer coating 24. The carton side seam is then formed by flame sealing the coating 26 on outer panel 10 to the skived and hemmed carton edge, thereby forming both a matte/gloss and a matte/matte seal surface, which are polar/non-polar and polar/polar, respectively.

While the foregoing seals are widely used in a variety of circumstances, they are inadequate when polar materials, such as, but not inclusive of, ethylene vinyl alcohol copolymer (EVOH), polyethylene terephthalate (PET) or nylon, or combinations thereof, are used for either the inside or outside coating because a commercially acceptable polar-polar polymer seal using commercial flame sealing technology does not exist, although polar/non-polar seals are possible. Since International Paper Co.'s Dual-Lock containers employ a layer of ethylene vinyl alcohol (EVOH) on the side contacting the product, (the matte side), a skived side seam cannot be produced due to the difficulty in obtaining an EVOH/EVOH seal on commercial flame side seaming equipment.

Figure 5:
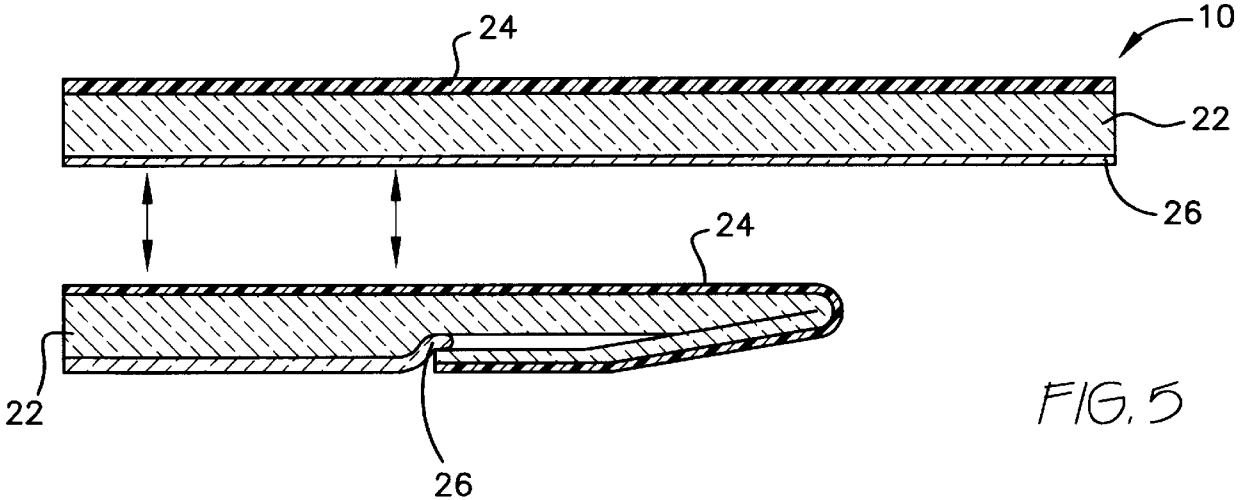
FIG. 5 is a cross sectional view of a reverse skive and hem according to the present invention.
Figure 4:
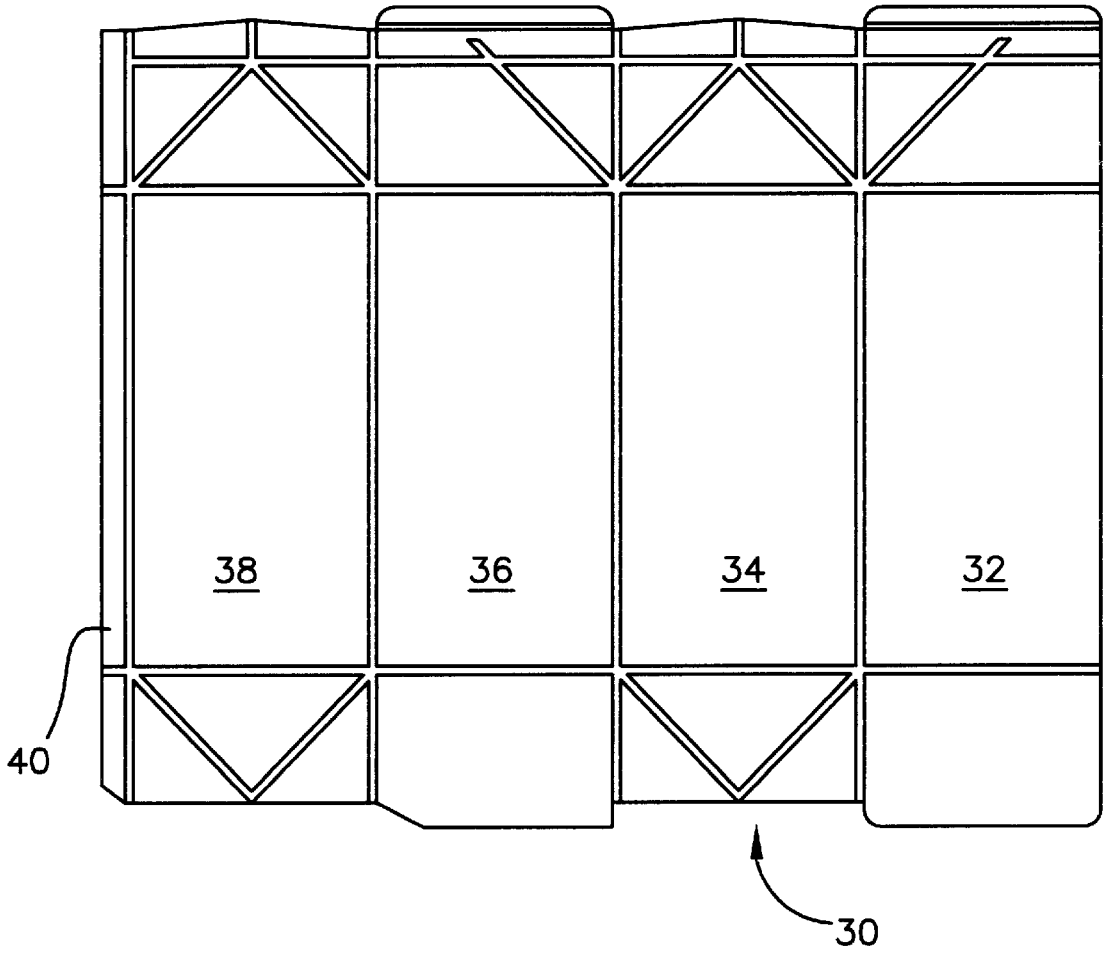
FIG. 4 shows a container blank according to the present invention on which the locations of the scored lines and panels are indicated.

The present invention creates a reverse skive and hem side seam so that there is no exposed raw paperboard edge and is configured so that no EVOH/EVOH seal is required. All the side-seam seals are low density polyethylene/EVOH. Such a reverse skive and hem sealed carton can be produced on commercially available equipment. Referring to FIGS. 4 and 5, the present invention will now be described.

FIG. 4 shows a container blank 30 according to the present invention on which the locations of the scored lines and panels are indicated. The blank 30 comprises five panels 32, 34, 36, 38, and 40 (which is a side seam panel). The blank 30 illustrated in FIG. 4 is for a gable top carton, such as those used to package fruit juice. In the reverse skive and hem process of the present invention, the side seam flap 40 is joined to the panel 32, as described below with reference to FIG. 5.

Approximately 80% of the thickness, and about 33% of the width of the side seam flap 40 are removed on the matte side of the side seam flap 40. The removal is performed with a high speed rotating paper saw. The material removed includes paperboard 22 and inner coating 26. The matte coating 26 adjacent the skived portion is then heated to melt the polymers. The skived side seam flap 40 is then folded so that the remaining paperboard 22 and polymer 24 is sealed to the molten polymers on the matte coating 26.

Subsequently, the gloss coating 24 on the side seam panel 40 and the matte coating 26 of the first panel 32 are heated to melt the polymers on the surface and are sealed, formed a flattened square tube. In a typical example the outer coating 24 is polyethylene, the paperboard 22 is treated with various polymers depending upon the intended contents, and the inner coating 26 is EVOH. Once the carton is formed into a square tube, bottom formed and sealed, it is filled and top sealed on filling machines designed and commercially built for such a purpose.

The previously known skiving methods and seals could not achieve a polar-polar seal, such as EVOH-EVOH, using current state of the art skived side seaming technology. For a matte/gloss interface, the regular or standard side seam sealing could achieve covalent-covalent or covalent-polar seams, but could not produce polar-polar seams. Similarly, regular skived seams and skived and hemmed seams could produce covalent-covalent or covalent-polar seams, but could not produce polar-polar seams, despite the need for them. The reverse skive and hemmed seam of the present invention can produce covalent-covalent or covalent-polar seams, and eliminates any need for polar-polar seams, thus allowing the use of a wider range of coating materials that maintain product quality.

For a matte/matte interface, polar-polar seams previously did not exist for regular or skived side seam sealing. Regular skived seams and skived and hemmed seams could produce covalent-covalent seams, and covalent-polar seams, but they are not required. However, they cannot produce polar-polar seams. The reverse skive and hemmed seam of the present invention only produce covalent-polar seams, and is configured thereby to eliminate any need for polar-polar seams.

Having described the reverse skive and hemmed paperboard polymer coated carton having protected board raw edge surfaces for packaging food and non-food products in accordance with the present invention, it is believed that other modifications, variations and changes will be suggested to those skilled in the art in view of the description set forth above. For example, the minimum and maximum dimensions of the skive portion can be varied depending upon the equipment limitations and the durability testing of the filled cartons. Furthermore the structure can be varied to minimize the presence of pin holes in the gloss side folded over edge on the side seam flap using reverse skive and hem technology, and can be tailored to meet the requirements of the product contained in the carton. It is therefore to be understood that all such variations, modifications and changes are believed to fall within the scope of the invention as defined in the appended claims.

What is claimed is:

1. A container, comprising:

first and second heat sealable layers on inner and outer surfaces, respectively, of said blank, and an intermediate layer;

a skived strip along an edge on said first heat sealable layer and a portion of said intermediate layer;

an inward fold of said skived strip back over said first heat sealable layer;

said folded skived strip being heat sealed to said first heat sealable layer on said inner face of said blank; and said heat sealed folded skived strip and said first heat sealable layer on said inner surface of said blank on an edge opposite said edge having said skived portion being heat sealed together.

2. A container as recited in claim 1, wherein said first heat sealable layer adjacent said skived portion is melted.

3. A container as recited in claim 1, wherein said skived portion is formed to remove approximately 80% or more of a thickness of said blank.

4. A container as recited in claim 1, wherein said first heat sealable layer is a polar material.

5. A container as recited in claim 4, wherein said polar material is one of ethylene vinyl alcohol copolymer, polyethylene terephthalate, and nylon or combinations thereof.

6. A container as recited in claim 1, wherein said intermediate layer is paperboard.

7. A sealable sheet of material for forming a container comprising:

first and second heat sealable layers on inner and outer surfaces, respectively, on an intermediate sheet of paperboard;

a skived strip formed on an inner side of said first heat sealable layer and a portion of said paperboard along an edge on said first heat sealable layer and a portion of said paperboard;

an inward fold of said skived strip back over said first heat sealable layer;

said folded skived strip being heat sealed to said first heat sealable layer on said inner face of said paperboard; and said heat sealed folded skived strip and said first heat sealable layer on said inner surface of said paperboard on an edge opposite said edge having said skived portion being heat sealed together.

* * * * *